United States Patent [19]

Vatsky et al.

[11] 4,348,170

[45] Sep. 7, 1982

[54] DUAL REGISTER, SPLIT STREAM BURNER ASSEMBLY WITH DIVIDER CONE

[75] Inventors: Joel Vatsky, Millburn; Norman K. Trozzi, West Caldwell, both of N.J.

[73] Assignee: Foster Wheeler Energy Corporation, Livingston, N.J.

[21] Appl. No.: 156,309

[22] Filed: Jun. 4, 1980

[51] Int. Cl.[3] ..... F23M 9/00; B05B 1/14

[52] U.S. Cl. ..... 431/188; 431/186; 239/552; 239/416.5

[58] Field of Search ..... 431/8, 12, 173, 184, 431/182, 188, 187, 189, 186; 239/574, 416.5, 417.5, 403, 465, 552, 553, 565, 424, 423; 110/263, 264

[56] References Cited

U.S. PATENT DOCUMENTS

| | | | |
|---|---|---|---|
| 1,870,013 | 8/1932 | Keenan, Jr. | 431/182 |
| 1,995,934 | 3/1935 | Mangolo | 239/416.5 |
| 2,480,547 | 8/1949 | Caracristi . | |
| 2,525,432 | 10/1950 | Stadler | 239/552 X |
| 2,815,069 | 12/1957 | Garraway | 431/188 |
| 3,411,716 | 11/1968 | Stephan et al. | 239/552 X |
| 3,944,142 | 3/1976 | Welden et al. | 239/552 |
| 4,050,632 | 9/1977 | Wyse | 239/552 X |
| 4,087,050 | 5/1978 | Tsuji et al. | 239/490 |
| 4,253,403 | 3/1981 | Vatsky | 431/188 |

*Primary Examiner*—Samuel Scott
*Assistant Examiner*—Randall L. Green
*Attorney, Agent, or Firm*—Marvin A. Naigur; John E. Wilson; Warren B. Kice

[57] ABSTRACT

A burner assembly in which an inlet is located at one end of an annular passage for receiving fuel, and an outlet is located at the other end of the passage for discharging the fuel. A divider cone is disposed within the annular passage for dividing the stream of fuel passing through the passage into two parallel coaxial streams and additional secondary air is introduced into the outer stream. A plurality of V-shaped members are disposed within the annular passage for splitting up the outer stream of fuel so that, upon ignition of said fuel, a plurality of flame patterns are formed. A register assembly is provided which includes an enclosure for receiving air and a divider for direction the air from the enclosure towards the outlet in two parallel paths extending around the burner. Register vanes are disposed in each of the paths for regulating the spin and/or quantity of air flowing through the paths.

26 Claims, 5 Drawing Figures

DUAL REGISTER, SPLIT STREAM BURNER ASSEMBLY WITH DIVIDER CONE

BACKGROUND OF THE INVENTION

This invention relates generally to a burner assembly and, more particularly, to an improved burner assembly which operates in a manner to reduce the formation of nitrogen oxides as a result of fuel combustion.

Considerable attention and efforts have recently been directed to the reduction of nitrogen oxides resulting from the combustion of fuel, and especially in connection with the use of coal in the furnace sections of relatively large installations such as vapor generators, and the like. In a typical arrangement for burning coal in a vapor generator, several burners are disposed in communication with the interior of the furnace and operate to burn a mixture of air and pulverized coal. The burners used in these arrangements are generally of the type in which a fuel-air mixture is continuously injected through a nozzle so as to form a single relatively large flame. As a result, the surface area of the flame is relatively small in comparison to its volume, and therefore the average flame temperature is relatively high. However, in the burning of coal, nitrogen oxides are formed by the fixation of atmospheric nitrogen available in the combustion supporting air, which is a function of the flame temperature. When the flame temperature exceeds 2800° F., the amount of fixed nitrogen removed from the combustion supporting air rises exponentially with increases in the temperature. This condition leads to the production of high levels of nitrogen oxides in the final combustion products, which cause severe air pollution problems.

Nitrogen oxides are also formed from the fuel bound nitrogen available in the fuel itself, which is not a direct function of the flame temperature, but is related to the quantity of available oxygen during the combustion process.

In view of the foregoing, attempts have been made to suppress the flame temperatures and reduce the quantity of available oxygen during the combustion process and thus reduce the formation of nitrogen oxides. Attempted solutions have included techniques involving two stage combustion, flue gas recirculation, the introduction of an oxygen-deficient fuel-air mixture to the burner, and the breaking up of a single large flame into a plurality of smaller flames. However, although these attempts singularly may produce some beneficial results, they have not resulted in a reduction of nitrogen oxides to minimum levels.

SUMMARY OF THE INVENTION

It is therefore an object of the present invention to provide a burner assembly which operates in a manner to considerably reduce the production of nitrogen oxides in the combustion of fuel.

It is a more specific object of the present invention to provide a burner assembly in which the surface area of the flame per unit volume is increased which results in a greater flame radiation, a lower flame temperature, and a shorter residence time of the combustion constituents within the flame at maximum temperature.

It is a still further object of the present invention to provide a burner assembly of the above type in which the stoichiometric combustion of the fuel is regulated to reduce the quantity of available oxygen during the combustion process and achieve an attendant reduction in the formation of nitrogen oxides.

Another more specific object of the present invention is to provide a burner assembly of the above type in which secondary air is directed toward the burner outlet in two parallel paths with register means being disposed in each path for individually controlling the flow of air through each path.

It is a more specific object of the present invention to provide a burner assembly of the above type in which the fuel is passed through an annular passage and is divided into two separate coaxial streams with one of the streams being split up to form a plurality of flame patterns.

Still another object of the present invention is to provide a burner assembly of the above type in which a stream of fuel and air is introduced into the burner in a tangential direction.

Toward the fulfillment of these and other objects, the burner assembly of the present invention includes an annular passage having an inlet located at one end thereof for receiving fuel, and an outlet located at the other end of the passage for discharging the fuel. A divider cone is disposed within the annular passage for dividing the stream of fuel passing through the passage into two parallel coaxial streams and additional secondary air is introduced into the outer stream. A plurality of V-shaped members are disposed in the path of the outer stream for splitting up the stream so that, upon ignition of the fuel, a plurality of flame patterns are formed. Secondary air is directed towards the outlet in two parallel paths extending around the burner, and a plurality of register vanes are disposed in each of the paths for regulating the quantity and swirl of the air flowing through the paths.

DESCRIPTION OF THE PREFERRED EMBODIMENTS

Figure 1:
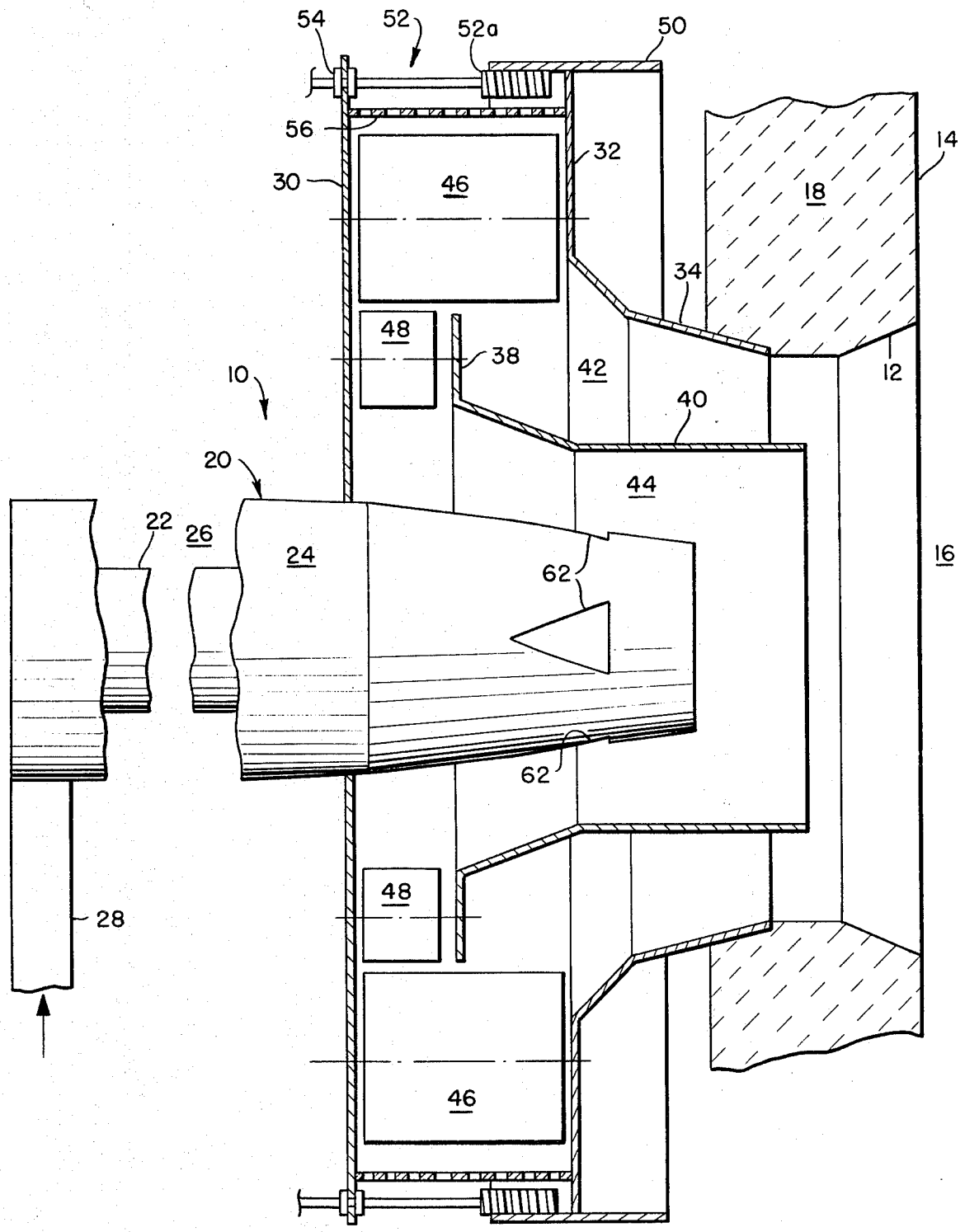
FIG. 1 is a sectional view depicting the burner assembly of the present invention.

Referring specifically to FIG. 1 of the drawings, the reference numeral 10 refers in general to a burner assembly which is disposed in axial alignment with a through opening 12 formed in a front wall 14 of a conventional furnace. It is understood that the furnace includes a back wall and a side wall of an appropriate configuration to define a combustion chamber 16 immediately adjacent the opening 12. Also, similar openings are provided in the furnace front wall 14 for accommodating additional burner assemblies identical to the burner assembly 10. The inner surface of the wall 14 as well as the other walls of the furnace are lined within an appropriate thermal insulation material 18 and, while not specifically shown, it is understood that the combustion chamber 16 can also be lined with boiler tubes through which a heat exchange fluid, such as water, is circulated in a conventional manner for the purposes of producing steam.

It is also understood that a vertical wall is disposed in a parallel relationship with the furnace wall 14 along with connecting top, bottom, and side walls to form a plenum chamber, or wind box, for receiving combustion supporting air, commonly referred to as "secondary air", in a conventional manner.

The burner assembly 10 includes a nozzle 20 having an inner tubular member 22 and an outer tubular member 24. The outer tubular member 24 extends over the inner tubular member 22 in a coaxial, spaced relationship thereto to define an annular passage 26 which extends towards the furnace opening 12. A tangentially spaced inlet 28 communicates with the outer tubular member 24 for introducing a stream of fuel and air into the annular passage 26 as will be explained in further detail later.

A pair of spaced annular plates 30 and 32 extend around the nozzle 20, with the inner edge of the plate 30 terminating on the outer tubular member 24. A liner member 34 extends from the inner edge of the plate 32 and in a general longitudinal direction relative to the nozzle 20 and terminates adjacent the insulation material 18 just inside the wall 14. An additional annular plate 38 extends around the nozzle 20 in a spaced, parallel relation with the plate 30. An air divider sleeve 40 extends from the inner surface of the plate 38 and between the liner 34 and the nozzle 20 in a substantially parallel relation to the nozzle and the liner 34 to define two air flow passages 42 and 44.

A plurality of outer register vanes 46 are pivotally mounted between the plates 30 and 32 to control the swirl of secondary air from the wind box to the air flow passages 42 and 44. In a similar manner a plurality of inner register vanes 48 are pivotally mounted between the plates 30 and 38 to further regulate the swirl of the secondary air passing through the annular passage 44. It is understood that although only two register vanes 46 and 48 are shown in FIG. 1, several more vanes extend in a circumferentially spaced relation to the vanes shown. Also, the pivotal mounting of the vanes 46 and 48 may be done in any conventional manner, such as by mounting the vanes on shafts (shown schematically) and journalling the shafts in proper bearings formed in the plates 30, 32 and 38. Also, the position of the vanes 46 and 48 may be adjustable by means of cranks or the like. Since these types of components are conventional they are not shown in the drawings nor will be described in any further detail.

Figure 2:
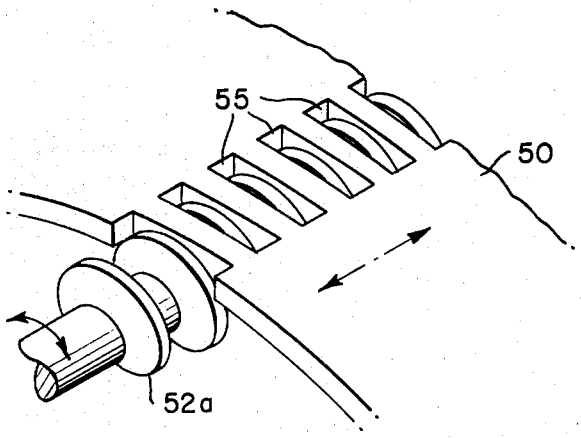
FIG. 2 is a partial perspective view of a component of the burner assembly of FIG. 1.

The quantity of air flow from the wind box into the vanes 46 is controlled by movement of a sleeve 50 which is slidably disposed on the outer periphery of the plate 32 and is movable parallel to the longitudinal axis of the nozzle 20. An elongated worm gear 52 is provided for moving the sleeve 50 and extends through a bushing 54 which is attached to the plate 30 to provide rotatable support. The worm gear 52 has one end portion suitably connected to an appropriate drive means (not shown) for rotating the worm gear and the other end provided with threads 52*a*. As shown in FIG. 2, the threads 52*a* of the worm gear 52 mesh with appropriate apertures 55 formed in the sleeve 50 so that, upon rotation of the worm gear, the sleeve moves longitudinally with respect to the longitudinal axis of the nozzle 20 and across the air inlet defined by the plates 30 and 32 (FIG. 1). In this manner, the quantity of combustion supporting air from the wind box passing through the air flow passages 42 and 44 can be controlled by axial displacement of the sleeve 50. A perforated air hood 56 extends between the plates 30 and 32 immediately downstream of the sleeve 50 to permit independent measurement of the secondary air flow to the burner by means of static pressure differential measurements. This is a conventional means of measuring flow and the measuring apparatus is not shown.

Figure 4:
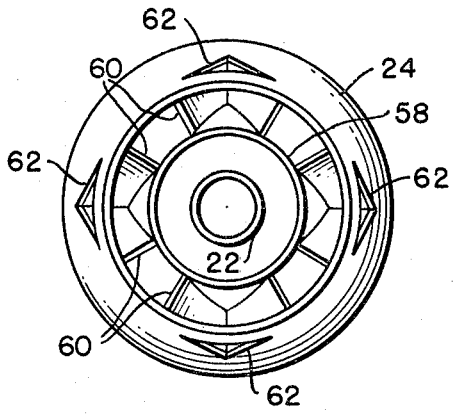
FIG. 4 is a front elevational view of the nozzle of FIG. 3.
Figure 3:
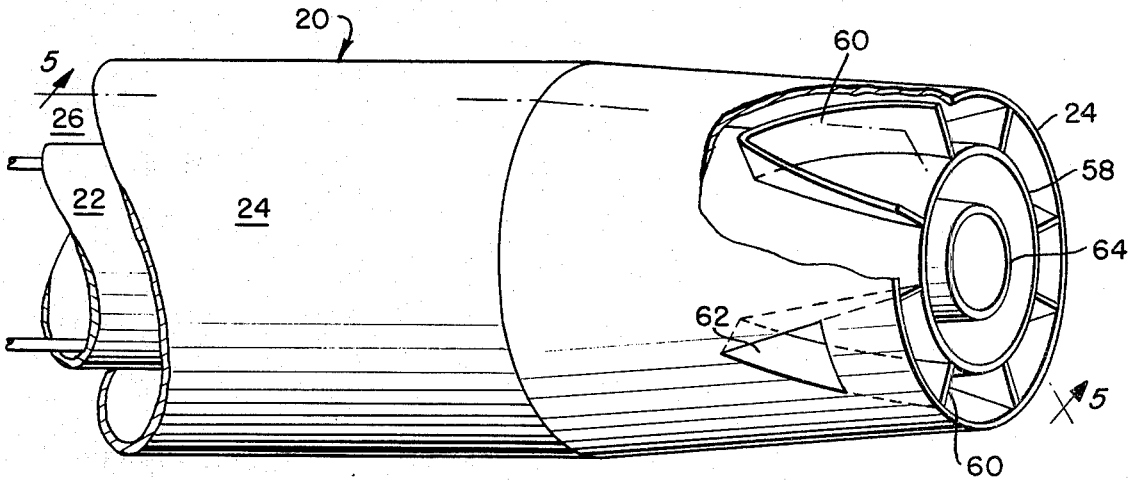
FIG. 3 is an enlarged elevational view, partially cutaway, of the nozzle of the assembly of FIG. 1.
Figure 5:
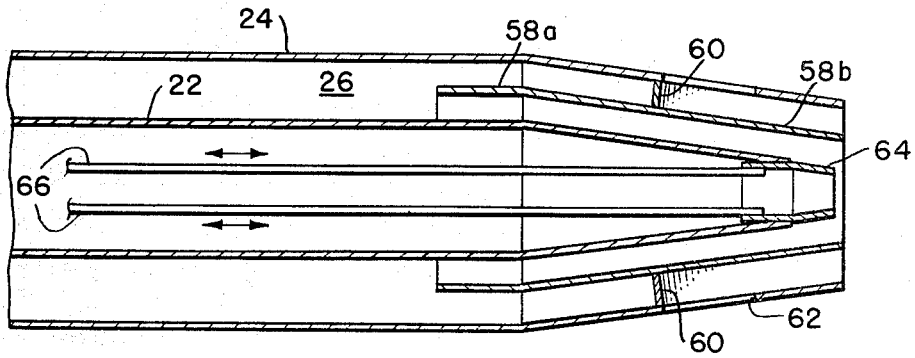
FIG. 5 is a longitudinal cross-sectional view of the nozzle of FIG. 3.

As shown in FIGS. 3–5, which depict the details of the nozzle 20, the end portion of the outer tubular member 24 and the corresponding end portion of the inner tubular member 22 are tapered slightly radially inwardly toward the furnace opening 12. A divider cone 58 extends between the inner tubular member 22 and the outer tubular member 24. The divider cone 58 has a straight portion 58*a* (FIG. 5) which extends between the straight portions of inner tubular member 22 and the outer tubular member 24, and a tapered portion 58*b* which extends between the tapered portions of the tubular members for the entire lengths thereof. The function of the divider cone 58 will be described in greater detail later.

A plurality of V-shaped splitters 60 are circumferentially spaced in the annular space between the outer tubular member 24 and the divider cone 58 in the outlet end portion of the nozzle 20. As shown in FIGS. 3 and 4, four such splitters 60 are spaced at 90° intervals and extend from the outlet to a point approximately midway between the tapered portions of the tubular members 22 and 24. Each splitter 60 is formed by two plate members welded together at their ends to form a V-shape. The plate members are also welded along their respective longitudinal edges to the outer tubular member 24 and the divider cone 58 to support the splitters and the divider cone in the nozzle 20. The apex of each splitter 60 is disposed upstream of the nozzle outlet so that the fuel-air stream flowing in the annular space between the divider cone 58 and the outer tubular member 24 will be directed into the adjacent spaces defined between the splitters to facilitate the splitting of the fuel stream into four separate streams.

Four pie-shaped openings 62 are formed through the outer tubular member 24 and respectively extend immediately over the splitters 60. These openings are for the purpose of admitting secondary air from the inner air flow passage 44 (FIG. 1) into the annular space defined between the divider cone 58 and the outer tubular member 24 for reasons that will be explained in detail later.

As shown in FIG. 5, a tip 64 is formed on the end of the tapered portion of the inner tubular member 22 and is movable relative to the latter member by means of a plurality of rods 66 extending within the tubular member and affixed to the inner wall of the tip. The other ends of the rods 66 can be connected to any type of actuator device (not shown) such as a hydraulic cylinder or the like to effect longitudinal movement of the rods and therefore the tip 64 in a conventional manner.

It can be appreciated from a view of FIG. 5 that the longitudinal movement of the tip 64 varies the effective outlet opening defined between the tip and the divider cone 58 so that the amount of fuel-air flowing through this opening can be regulated. Since the divider cone 58 divides the fuel-air mixture flowing through the annular passage 26 into two radially spaced parallel streams extending to either side of the divider cone 58, it can be appreciated that movement of the tip 64 regulates the relative flow of the two streams while varying their velocity.

It is understood that appropriate igniters can be provided adjacent the outlet of the nozzle 20 for igniting the coal as it discharges from the nozzle. Since these ignitors are of a conventional design they have not been shown in the drawings in the interest of clarity.

In operation of the burner assembly of the present invention, the movable sleeve 50 associated with each burner is adjusted during initial start up to accurately balance the air to each burner. After the initial balancing, no further movement of the sleeves 50 are needed since normal control of the secondary air flow to the burners is accomplished by operation of the outer burner vanes 46. However, if desired, flow control can be accomplished by the sleeve.

Fuel, preferably in the form of pulverized coal suspended or entrained within a source of primary air, is introduced into the tangential inlet 28 where it swirls through the annular chamber 26. Since the pulverized coal introduced into the inlet 28 is heavier than the air, the pulverized coal will tend to move radially outwardly towards the inner wall of the outer tubular member 24 under the centrifugal forces thus produced. As a result, a great majority of the coal along with a relatively small portion of air enters the outer annular passage defined between the outer tubular member 24 and the divider cone 58 (FIG. 5) where it encounters the apexes of the splitters 60. The stream is thus split into four equally spaced streams which discharge from the nozzle outlet and, upon ignition, form four separate flame patterns. Secondary air from the inner air passage 44 (FIG. 1) passes through the inlets 62 formed in the outer tubular member 24 and enters the annular passage between the latter member and the divider cone 58 to supply secondary air to the streams of coal and air discharging from the outlet.

The remaining portion of the air-coal mixture passing through the annular passage 26 enters the annular passage defined between the divider cone 58 and the inner tubular member 22. The mixture entering this annular passage is mostly air due to the movement of the coal radially outwardly, as described above. The position of the movable tip 64 can be adjusted to precisely control the relative amount, and therefore velocity, of the air and coal discharging from the nozzle 20 from the annular passages between the outer tubular member 24 and the divider cone 58 and between the divider cone and the inner tubular member 22.

Secondary air from the wind box is admitted through the perforated hood 56 and into the inlet between the plates 30 and 32. The axial and radial velocities of the air are controlled by the register vanes 46 and 48 as it passes through the air flow passages 42 and 44 and into the furnace opening 12 for mixing with the coal from the nozzle 20. The igniters are then shut off after steady state combustion has been achieved.

As a result of the foregoing, several advantages result from the burner assembly of the present invention. For example, since the pressure drop across the perforated air hoods 56 associated with the burner assemblies can be equilized by balancing the secondary air flow to each burner by initially adjusting the sleeves 50, a substantially uniform flue gas distribution can be obtained across the furnace. This also permits a common wind box to be used and enables the unit to operate at lower excess air with significant reductions in both nitrogen oxides and carbon monoxides. Also, the provision of separate register vanes 46 and 48 for the outer and inner air flow passages 42 and 44 enables secondary air distribution and flame shape to be independently controlled resulting in a significant reduction of nitrogen oxides, and a more gradual mixing of the primary air coal stream with the secondary air since both streams enter the furnace on parallel paths with controlled mixing.

Further, the provision of multiple flame patterns results in a greater flame radiation, a lower average flame temperature and a shorter residence time of the gas components within the flame at a maximum temperature, all of which, as stated above, contribute to reduce the formation of nitric oxides.

Still further, the provision of the tangential inlet 26 provides excellent distribution of the fuel around the annular space 26 in the nozzle 20, resulting in more complete combustion and reduction of carbon loss and making it possible to use individual burners with capacities significantly higher than otherwise could be used. Provision of the inlet openings 62 in the outer tubular member permits the introduction of a portion of the secondary air to be entrained with the fuel-air stream passing through the annular passage between the outer tubular member 24 and the divider cone, since the majority of this stream will be primarily pulverized coal. As a result, a substantially uniform air-coal ratio across the entire cross-section of the air-coal stream is achieved. Also, the provision of the movable tip 64 to regulate the flow of the coal-air mixture passing through the inner annular passage defined between the divider cone 58 and the inner tubular member 22 enable the air flow on both sides of the divider cone to be regulated thereby optimizing the primary air velocity with respect to the secondary air velocity.

It is understood that several variations and additions may be made to the foregoing within the scope of the invention. For example, since the arrangement of the present invention permits the admission of air at less than stoichiometric, overfire air ports, or the like can be provided as needed to supply air to complete the combustion.

As will be apparent to those skilled in the art, various changes and modifications may be made to the embodiments of the present invention without departing from the spirit and scope of the present invention as defined in the appended claims and the legal equivalent.

What is claimed is:

1. A burner assembly comprising means defining an annular passage, means for supplying fuel to said passage, an inlet located at one end of said passage for receiving said fuel, and an outlet located at the other end of said passage for discharging said fuel, means disposed within said annular passage for dividing the stream of fuel passing through said passage into two parallel streams, means for splitting up one of said streams as it discharges from said opening so that upon ignition of said fuel, a plurality of flame patterns are formed, and a register assembly associated with said burner, said register assembly comprising an enclosure extending over said passage for receiving air, and means for directing said air from said enclosure towards said outlet in two parallel paths extending around said passage, and a plurality of vanes respectively disposed in each of said paths for regulating the spin and/or quantity of air flowing through said paths.

2. The burner assembly of claim 1 wherein said passage defining means comprises an inner tubular member, and an outer tubular member extending around said inner tubular member in coaxial relation thereto.

3. The burner assembly of claim 2 wherein said stream dividing means comprises a tubular divider member disposed in said passage to divide said stream into an inner stream, and an outer stream extending around said inner stream.

4. The burner assembly of claim 3 wherein said splitting means extends between said outer tubular member and said divider member.

5. The burner assembly of claim 1 wherein said splitting means comprises a plurality of V-shaped members extending in circumferentially spaced relationship in said passage and disposed in said passage so that the apex of each member faces upstream and said one stream impinges against said members which direct said stream into the spaces between said members.

6. The burner assembly of claim 3 further comprising an air inlet opening formed in a portion of said outer tubular member extending over said splitting means for admitting air from one of said paths to said outer stream.

7. The burner assembly of claim 1 further comprising means for regulating the flow rate of at least one of said streams.

8. The burner assembly of claim 7 wherein said flow rate regulating means comprises a movable tip disposed on the end of said inner tubular member and movble relative to said inner tubular member.

9. The burner assembly of claim 1 wherein said means for supplying fuel comprises means for directing fuel through said inlet and into said passage in a tangential direction relative to said passage.

10. The burner assembly of claim 1 further comprising a sleeve movable across the inlet to said enclosure to vary the size of said inlet and regulate the quantity of air entering said enclosure.

11. A burner assembly comprising means defining an annular passage, means for supplying fuel to said passage, an inlet located at one end of said passage for receiving said fuel, and an outlet located at the other end of said passage for discharging said fuel; a divider member disposed within said annular passage for dividing the stream of fuel passing through said passage into two radially-spaced parallel streams, and means for splitting up one of said streams as it discharges from said opening so that, upon ignition of said fuel, a plurality of flame patterns are formed.

12. The burner assembly of claim 11 wherein said passage defining means comprises an inner tubular member, and an outer tubular member extending around said inner tubular member in a coaxial relation thereto, said divider member extending between said inner tubular member and said outer tubular member.

13. The burner assembly of claim 12 wherein said splitting means extends between said outer tubular member and said divider member in the path of said outer stream.

14. The burner assembly of claim 13 further comprising an air inlet opening formed in a portion of said outer tubular member extending over said splitting means for admitting air to said outer stream.

15. The burner assembly of claim 11 wherein said splitting means comprises a plurality of V-shaped members extending in a circumferentially spaced relationship in said passage and disposed in said passage so that the apex of each member faces upstream and said one stream impinges against said members which direct said stream into the spaces between said members.

16. The burner assembly of claim 11 further comprising means for regulating the flow rate of at least one of said streams.

17. The burner assembly of claim 16 wherein said flow rate regulating means comprises a movable tip disposed on the end of said inner tubular member and movable relative to said inner tubular member.

18. The burner assembly of claim 11 wherein said means for supplying fuel comprises means for directing fuel through said inlet and into said passage in a tangential direction relative to said passage.

19. The burner assembly of claim 11 further comprising a register assembly associated with said burner, said register assembly comprising an enclosure extending over said passage for receiving air, means for directing said air from said enclosure towards said outlet, and a sleeve movable across the inlet to said enclosure to vary the size of said inlet and regulate the quantity of air entering said enclosure.

20. A burner assembly comprising an inner tubular member, and an outer tubular member extending around said inner tubular member in a coaxial relation thereto to define an annular passage, inlet means located at one end of said passage for directing a stream of pulverized coal and air into said passage in a tangential relation relative to said passage, an outlet located at the other end of said passage for discharging said stream; means disposed within said annular passage for dividing the stream passing through said passage into two radially spaced parallel streams, a substantial portion of said coal flowing into the outer stream by centrifugal forces, means for regulating the flow rate of at least one of said streams, and an air inlet opening formed in a portion of said outer tubular member for admitting air to said outer stream as said outer stream discharges from said outlet.

21. The burner assembly of claim 20 wherein said stream dividing means comprises a tubular divider member disposed in said passage between said inner tubular member and said outer tubular member.

22. The burner assembly of claim 21 further comprising means for splitting up one of said streams as it discharges from said opening so that upon ignition of said coal, a plurality of flame patterns are formed.

23. The burner assembly of claim 22 wherein said splitting means extends between said outer tubular member and said divider member and splits up said outer stream.

24. The burner assembly of claim 22 wherein said splitting means comprises a plurality of V-shaped members extending in a circumferentially spaced relationship in the annular space between said outer tubular member and said divider member and disposed in said passage so that the apex of each member faces upstream and said outer stream flows against said members which direct said stream into the spaces between said members.

25. The burner assembly of claim 20 further comprising a register assembly associated with said burner, said register assembly comprising an enclosure extending over said passage for receiving air, means for directing said air from said enclosure towards said outlet, and a sleeve movable across the inlet to said enclosure to vary the size of said inlet and regulate the quantity of air entering said enclosure.

26. The burner assembly of claim 20 wherein said flow rate regulating means comprises a movable tip disposed on the end of said inner tubular member and movable relative to said inner tubular member.

* * * * *